US007954661B2

(12) United States Patent
Uchida et al.

(10) Patent No.: US 7,954,661 B2
(45) Date of Patent: Jun. 7, 2011

(54) TRANSPORT CONTAINER, TRANSPORTING METHOD FOR THE SAME, AND CONSTANT TEMPERATURE TRANSPORT CONTAINER

(75) Inventors: Mari Uchida, Tsuchiura (JP); Hiroshi Kusumoto, Hitahinaka (JP); Hiroaki Matsushima, Ryugasaki (JP)

(73) Assignee: Hitachi, Ltd., Tokyo (JP)

( * ) Notice: Subject to any disclaimer, the term of this patent is extended or adjusted under 35 U.S.C. 154(b) by 538 days.

(21) Appl. No.: 11/733,800

(22) Filed: Apr. 11, 2007

(65) Prior Publication Data

US 2007/0245763 A1 Oct. 25, 2007

(30) Foreign Application Priority Data

Apr. 20, 2006 (JP) ..... 2006-116284

(51) Int. Cl.
*B65D 81/38* (2006.01)

(52) U.S. Cl. ..... 220/592.26; 62/371; 62/457.2; 220/592.01; 220/592.2; 220/592.22

(58) Field of Classification Search ..... 62/371, 62/457.2; 220/592.26, 592.01, 592.2, 592.22
See application file for complete search history.

(56) References Cited

U.S. PATENT DOCUMENTS

| | | | | |
|---|---|---|---|---|
| 3,236,206 | A * | 2/1966 | Willinger | 119/203 |
| 6,433,732 | B1 * | 8/2002 | Dutta et al. | 342/357.07 |
| 7,196,627 | B2 | 3/2007 | Rommelmann et al. | |
| 2002/0069620 | A1 * | 6/2002 | Abasolo | 53/460 |
| 2005/0248456 | A1 * | 11/2005 | Britton et al. | 340/539.29 |
| 2006/0063621 | A1 * | 3/2006 | Bell et al. | 473/569 |
| 2007/0186577 | A1 * | 8/2007 | Goncharko | 62/371 |

FOREIGN PATENT DOCUMENTS

| | | | |
|---|---|---|---|
| JP | 1-66380 | U | 4/1989 |
| JP | 2004-217290 | | 8/2004 |
| JP | 2004-238051 | A | 8/2004 |
| JP | 2005-124556 | | 5/2005 |
| JP | 2005-350143 | A | 12/2005 |
| JP | 2006-006261 | | 1/2006 |
| JP | 2006-016044 | | 1/2006 |

OTHER PUBLICATIONS

Japanese Office Action Appln. 2006-116284 with English translation.

* cited by examiner

*Primary Examiner* — Anthony Stashick
*Assistant Examiner* — Elizabeth Volz
(74) *Attorney, Agent, or Firm* — Antonelli, Terry, Stout & Kraus, LLP.

(57) ABSTRACT

A transport container comprising a spherical container 1 and a heat accumulating material 2*a*, 2*b* disposed inside of the spherical container 1, wherein; the heat accumulating material 2*a*, 2*b* is provided with a space for holding a transported object therein, and the space is formed at the central part of the inside of the spherical container 1.

6 Claims, 5 Drawing Sheets

TRANSPORT CONTAINER, TRANSPORTING METHOD FOR THE SAME, AND CONSTANT TEMPERATURE TRANSPORT CONTAINER

CLAIM OF PRIORITY

The present application claims priority from Japanese application serial No. 2006-116284, filed on Apr. 20, 2006, the contents of which is hereby incorporated by reference into this application.

BACKGROUND OF THE INVENTION

1. Field of the Invention

The present invention relates to a container for storing biocells or cellular tissue medical instruments and a transport container for transporting them.

2. Prior Art

Cultured cells used for regenerating medical treatment is desirably transported from a culture installation to a hospital under the same condition as the culture temperature. For that purpose, a strict temperature control technology is necessary. To keep temperature inside of a transport container uniform, a temperature control apparatus comprising a cool-heat generator, a hot temperature generator, a circulating means for fluid in side of the container, and a control means and a heat insulating means for insulating a heat transfer between the inside of the container and the outer periphery of the container are necessary.

The prior art of a constant temperature transport container for thermally insulating and transporting substances such as cellular tissue is described in the Patent Documents 1 and 2.

In the prior art of the transport container described in the Patent Document 1, the inside container having temperature retaining function due to the heat accumulating material is disposed inside of the outside container having heat insulation function, thus transport for a long time is enabled.

On the other hand, in the prior art of the transport container described in the Patent Document 2, the container body is composed of the metallic container, and the periphery thereof is covered with the heat insulator, and the low temperature side of the Peltier element driven by the portable power source is mounted on a part of the metallic container, and the fan for circulating air in the container is installed, thus the temperature inside of the container can be controlled with high precision.

Further, in the Patent Document 3, the prior art for easily controlling information on the inside of the cell culturing container is described.

Further, in the Patent Document 4, the prior art for holding the transported object at the central part of the spherical container is described.

Patent Document 1: Japanese Patent Application Laid-open Publication No. 2004-217290

Patent Document 2: Japanese Patent Application Laid-open Publication No. 2005-124556

Patent Document 3: Japanese Patent Application Laid-open Publication No. 2006-06261

Patent Document 4: Japanese Patent Application Laid-open Publication No. 2006-16044

SUMMARY OF THE INVENTION

The transport container described in the Patent Document 1 can hold a transported object within a predetermined temperature range by a simple constitution. Further, the transport container described in the Patent Document 2 transfers cool and hot heat generated by the Peltier element to the metallic container and via the air flow circulating inside of the container, controls the temperature of the transported object with high precision. However, the transport containers described in the Patent Documents 1 and 2 leave room for reducing the heat radiation amount.

Further, the prior art described in the Patent Document 3, although the contents of the transported object can be known, describes no transport history information.

Further, the prior art described in the Patent Document 4, although the container is made spherical to improve the transport efficiency, describes no heat-retaining property.

An object of the present invention, in a constant temperature transport container with a simple constitution, is to keep the temperature of a transported object within a predetermined temperature range for a long time. Another object of the present invention is to enable transport of a transported object such as cells etc. at a constant temperature over a long period of time. And, it is an object to accomplish at least one of the objects.

To accomplish the above objects, the transport container of the present invention is structured as indicated below. Namely, it has a structure having a spherical container and a heat accumulating material disposed inside of the spherical container, wherein the heat accumulating material is provided with a space for holding a transported object therein, and the space is formed at the central part of the inside of the spherical container.

According to the present invention, the heat accumulating material is arranged in a spherical shape around the transported object, so that almost all of the quantity of heat possessed by the heat accumulating material can be used to retain the temperature of the transported object. Further, the transport container is spherical, so that the heat radiation area is small and the temperature retaining time can be prolonged.

DETAILED DESCRIPTION OF THE INVENTION

Hereinafter, an embodiment of the constant temperature transport container relating to the present invention will be explained with reference to FIGS. 1 and 2.

Figure 1:
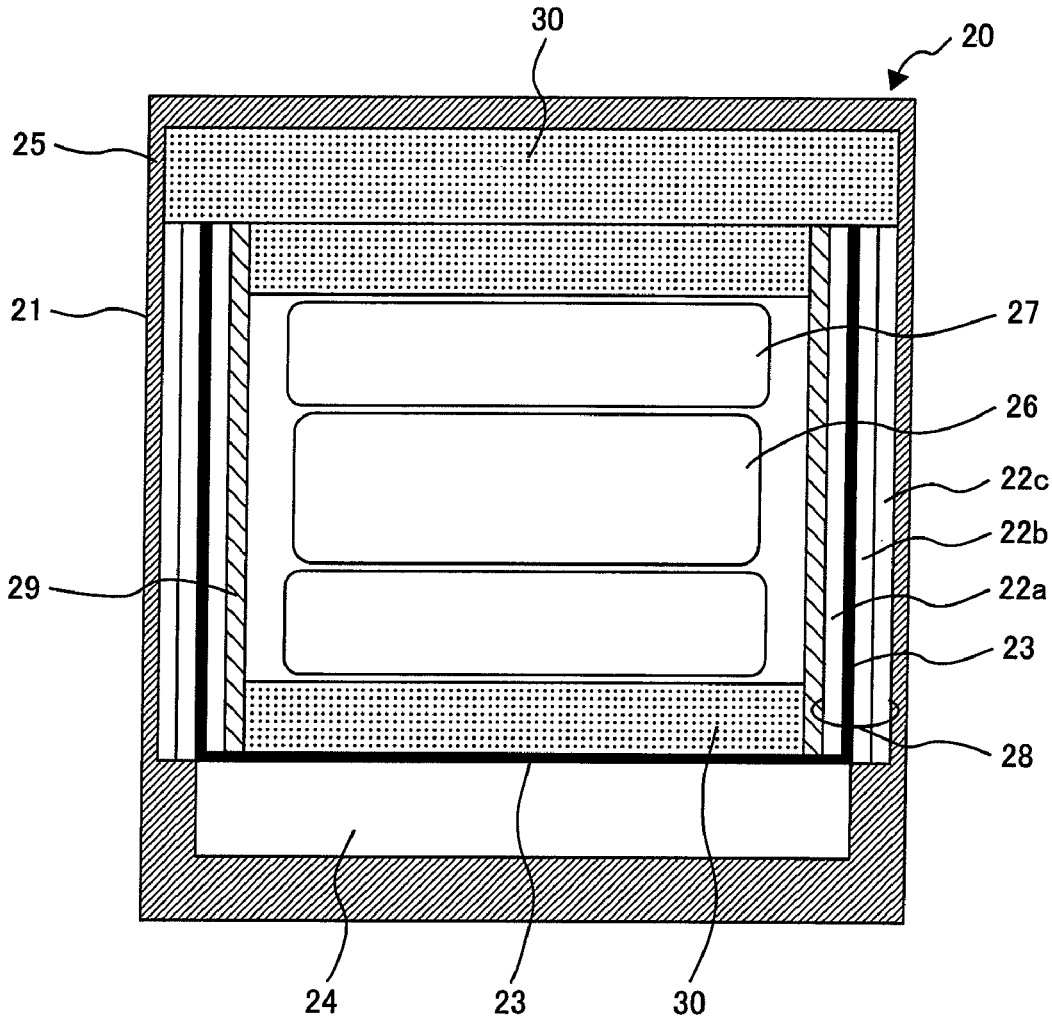
FIG. 1 is a perpendicular cross sectional view to show the constant temperature transport container of the first embodiment in the present invention, FIG. 2(*a*) is a drawing to show an example of trial results of the heat loss by the heat insulating wall composed of a vacuum heat insulator and a heat conductive member in the embodiment of the present invention, and FIG. 2(*b*) is a cross sectional view to show the constitution of the heat insulating wall composed of a vacuum heat insulator and a heat conductive member in the embodiment of the present invention.

FIG. 1 shows a longitudinal cross sectional view of the constant temperature transport container. A constant temperature transport container 20 is composed of a heat insulating container 21, a heat insulating wall 28 combining a plurality of heat insulators such as vacuum heat insulators 22*a*, 22*b*, and 22*c* and a heat conductive member 23 such as heat conductive copper or aluminum, a cushioning material 30 using a material of expanded polystyrene, urethane foam, or sponge, and a protective material 29.

Inside of the constant temperature transport container 20, a heat accumulating container 27 for storing a first heat accumulating material and a heat accumulating container 26 for storing a transported object and the first heat accumulating material are installed. Here, the vacuum heat insulator is formed by sealing the periphery of the member, which is a fibriform core such as glass-wool, with a film material such as aluminum and evacuating the inside thereof.

On the bottom of the constant temperature transport container 20, a second heat accumulating material 24 having an almost same temperature characteristic as that of the first heat accumulating material is installed and is arranged so as to make thermally contact with a part of the heat conductive material 23.

Inside of a cover 25 positioned at the upper part of the constant temperature transport container 20, the cushioning material 30 serving as heat insulation and shock absorption is installed, and the cover 25 is structured so as to keep the airtightness of the inside of the container 20 using the elasticity of the cushioning material 30 and can be opened and closed the container 20.

Further, although not shown in FIG. 1, the second heat accumulating material 24, independently of the opening and closing operation of the cover 25 of the constant temperature transport container 20, is structured so as to be exchanged externally.

When there is a temperature difference between the inside of the container and the outer periphery of the container, a heat transfer is generated by driving force of the temperature difference, and the accumulated heat amount of the heat accumulating material disposed in the container is lost. However, in this embodiment, the heat insulating wall 28 surrounding the inside of the container 20 is composed of the heat conductive member 23 and vacuum heat insulators 22*a*, 22*b*, and 22*c* and the temperature of the heat conductive member 23 is maintained almost at the same temperature as that of the inside of the container 20 by the heat of the second heat accumulating material 24, so that the heat loss of the first heat accumulating material disposed inside of the container 20 can be reduced.

Next, the reduction in the heat loss due to a difference in the constitution of the heat insulating wall will be explained by referring to FIG. 2.

Figure 2A:
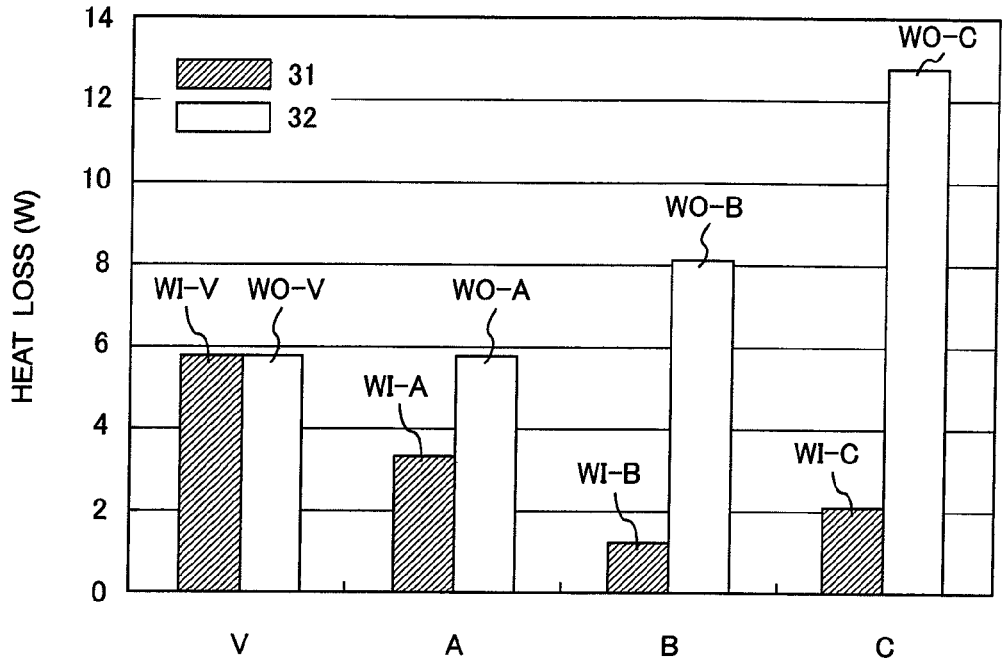
Figure 2B:
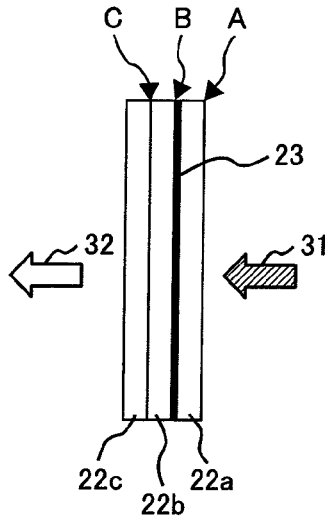

FIG. 2(*b*) is a cross sectional view showing the constitution of the heat insulating wall 28 composed of the three vacuum heat insulators 22*a*, 22*b*, and 22*c* and heat conductive member 23. As a position for installing the heat conductive member 23, there are three locations available such as the position A inside the vacuum heat insulator 22*a*, the position B between the vacuum heat insulators 22*a* and 22*b*, and the position C between the vacuum heat insulators 22*b* and 22*c*, and FIG. 2(*b*) shows a case that the heat conductive member 23 is installed at the position B.

FIG. 2(*a*) shows an example of trial results of the heat loss by the heat insulating wall 28 composed of the vacuum heat insulator 22 and heat conductive member 23. The heat insulating wall 28 used for the trial is composed of three vacuum heat insulators 22*a*, 22*b*, and 22*c* and one heat conductive member 23. The vacuum heat insulator 22 has dimensions of 5 mm in thickness, 0.5 m in height, and 1 m in length and thermal conductivity of 5 mW/(m·K). The heat conductive member 23 is a copper plate of 1 mm in thickness, 0.5 m in height, and 1 m in length. The temperature conditions are set such that the intra-container temperature on the side of the inner vacuum heat insulator 22*a* is 37° C., the temperature around the container on the side of the outer vacuum heat insulator 22*c* is 0° C., and the temperature at the base of the heat conductive member 23 is 37° C.

In the drawing, the axis of ordinate indicates a heat loss 31 inside the container and a heat loss 32 to the periphery of the container and the axis of abscissa indicates a difference in the constitution of the heat insulating wall. In the axis of abscissa, V indicates a constitution when the heat insulating wall 28 is composed of only a vacuum heat insulator 22, and A indicates a constitution when the heat conductive member 23 is arranged at the position A shown in FIG. 2(*b*), B a constitution when the heat conductive member 23 is arranged at the position B shown in FIG. 2(*b*), and C a constitution when the heat conductive member 23 is arranged at the position C shown in FIG. 2(*b*).

In the constitution V that the heat insulating wall 28 is composed of only a vacuum heat insulator 22, heat of about 5.8 W is transferred from the inside of the container 20 to the periphery, though the heat conductive member 23 is installed at the position B of the heat insulating wall 28 so as to be held by the vacuum heat insulator 22 and the base thereof is heated at the same temperature as that of the inside of the container 20, thus it is found that the heat loss WI-B inside the container 20 can be lowered to about 22%. As a result, the quantity of heat per unit time lost from the first heat accumulating material installed in the container 20 is reduced and the time for retaining the temperature of the transported object can be extended.

On the other hand, the heat loss WO-B to the periphery of the container 20 is increased due to installation of the heat conductive member 23, though the heat loss is compensated by the accumulated heat amount of the second heat accumulating material 24. The second heat accumulating material 24 can be exchanged from the outside of the container 20, so that it is exchanged with a new heat accumulating material at an appropriate time interval, thus the temperature can be retained for a long time.

Further, the exchange time of the heat accumulating material 24 is desirably decided by installation of a means for detecting the temperature of the heat accumulating material 24 or detecting the temperature of the heat conductive member 23 in contact with the heat accumulating material 24.

Further, as shown in FIG. 2(*a*), the magnitude of the heat loss varies greatly with the installation position of the heat conductive member 23. When the heat conductive member 23 is installed at the position A of the heat insulating wall 28, the reduction effect of the heat loss WI-A in the container 20 is small such as about 40%, though the heat loss WO-A to the periphery of the container 20 is different little from the heat loss WO-V in the case of only the vacuum heat insulator 22 used. However, when the heat conductive member 23 is installed at this position, it induces a natural convection current of internal air on the surface in contact with the inside of the container 20 and there is a risk actually that the heat loss WI-A in the container 20 may increase more. Further, when the heat conductive member 23 is installed at the position C of the heat insulating wall 28, it is found that compared with the heat loss WI-C in the container 20, the heat loss WO-C to the periphery of the container 20 is increased greatly.

Therefore, the heat conductive member 23 is desirably installed between the vacuum heat insulators 22 and as an installation method for the vacuum heat insulators 22, more vacuum heat insulators 22 are desirably installed on the surface in contact with the periphery of the container 20 instead of the surface in contact with the inside of the container 20.

In this embodiment, to maintain the temperature of the heat insulating wall 28, the heat accumulating material 24 is used, though an electric heater or a Peltier element using a portable power source as a drive source can be used. In this case, to control the base temperature of the heat conductive member 23 within a predetermined temperature range, the respective devices are controlled, though the temperature of the transported object is retained with high precision by the first heat accumulating material disposed inside the container 20, so that for the temperature of the heat insulating wall 28, highly precise control is not necessary. Therefore, the heat source device can be structured by a simple constitution and the consumed power can be suppressed as fully as possible.

Another embodiment of the transport container relating to the present invention will be explained by referring to FIG. 3. This embodiment relates to a storing method for a transported object.

Figure 3:
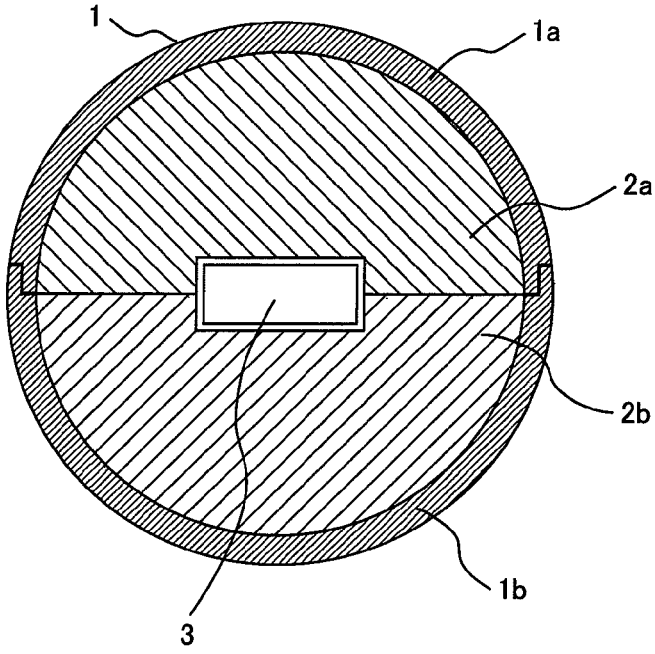
FIG. 3 is a cross sectional view to show the spherical container of the second embodiment in the present invention.

FIG. 3 is a longitudinal cross sectional view showing the storing container of a transported object. A spherical container 1 is composed of an upper hemispherical capsule 1*a* and a lower hemispherical capsule 1*b*, and a heat accumulating material 2*a* is disposed in the upper hemispherical capsule 1*a*, and a heat accumulating material 2*b* is disposed in the lower hemispherical capsule 1*b*. The heat accumulating materials 2*a*, 2*b*, to prevent scattering and leakage, are sealed and used in different containers from the upper and lower hemispherical capsules 1*a*, 1*b*. In this specification, unless otherwise specified, description of a container sealing a heat accumulating material will be omitted. Further, tools for fixing the upper and lower hemispherical capsules and keeping them unopened are not shown in the drawings.

A container 3 for storing a transported object such as cells is stored and held at the central part of the spherical container 1. The heat accumulating material 2*a*, 2*b* disposed inside of the spherical container 1 has a property of accumulating or emitting latent heat at time of phase change between a liquid and a solid. Using this property, the container 3 for storing a transported object can be protected from a thermal influence and shock.

When transporting a transported object near at the body temperature (about 37° C.), a transport container is roughly assembled by the following procedure.

Firstly, in a constant temperature bath, the upper and lower hemispherical capsules 1*a*, 1*b* are heated up to a set temperature. Furthermore, the heat accumulating material 2*a*, 2*b* is heated and melted at the solidification point or higher, thereby accumulates heat. At this time, if the heat accumulating material 2*a*, 2*b* in the liquid phase is heated excessively, when the container for storing the transported object therein is set in the spherical container 1, the transported object is heated to the body temperature or higher and there is a risk that the quality of the transported object may be damaged, so that it is necessary to note setting of the heating temperature. The container sealing the heat accumulating materials 2*a*, 2*b* respectively in the upper and lower spherical capsules 1*a*, 1*b* is mounted, and the container 3 storing the transported object therein is put on the heat accumulating material 2*b*, and the upper hemispherical capsule 1*a* and lower hemispherical capsule 1*b* are combined and fixed so as to be held by the upper and lower heat accumulating materials 2*a*, 2*b*.

At this time, the transport container 1 is spherical, so that it rolls easily. Therefore, when the lower hemispherical capsule 1*b* is made heavier than the upper hemispherical capsule 1*a* or a metallic lump having a specific gravity larger than that of the heat accumulating material 2*b* is put in the lower hemispherical capsule 1*b*, the gravity is positioned at the lower part of the transport container 1.

Further, to make the heat insulating time of each transport container uniform, the work is desirably executed in the constant temperature room.

Next, the advantages of the spherical container 1 will be explained. When there is no leakage of heat from the spherical container 1, the heat accumulating material 2*a*, 2*b* holds the latent heat straight in the liquid phase and can retain the transported object at a uniform temperature. On the other hand, when the external temperature of the spherical container 1 is lowered below the solidification point of the heat accumulating material 2*a*, 2*b*, heat begins to leak from the outer peripheral part and in correspondence with it, the heat accumulating material 2*a*, 2*b* emits the latent heat and starts solidification. In correspondence with progress of heat radiation, the solidification interface (the interfacial boundary between the solid and the liquid), according the balance between the heat radiation amount from the outer peripheral part of the heat accumulating material 2*a*, 2*b* and the latent heat radiation amount, moves toward the central part almost concentrically, though around the container 3 for storing the transported object located at the central part, the heat accumulating material 2*a*, 2*b* in the liquid phase exists still, so that the temperature can be kept constant. At the point of time when the heat accumulating material 2*a*, 2*b* in contact with the container 3 for storing the transported object solidifies, the temperature retaining function is lost, though the transported object and heat accumulating material 2*a*, 2*b* are installed in the spherical container 1 and the transported object is installed at the central position thereof, thus the accumulated heat amount of the heat accumulating material 2*a*, 2*b* can be used effectively to maintain the temperature of the transported object.

Further, the solidified heat accumulating material increases the heat resistance for obstructing heat transfer, so that an effect such that in correspondence with progress of solidification, the heat leakage amount is reduced can be obtained.

Figure 6:
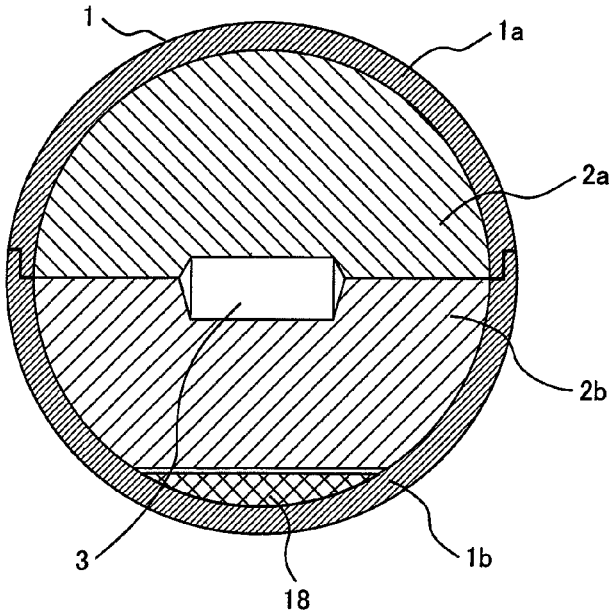
FIG. 6 is a cross sectional view to show the spherical container of the third embodiment in the present invention.

Still another embodiment of the transport container relating to the present invention will be explained by referring to FIG. 6. This embodiment adds a function for always keeping the transported object in the same posture to the spherical container 1 described in the second embodiment.

When transporting a transported object including a culture fluid such as cultured cells, to prevent the fluid from falling during transport, it is necessary to keep the posture of the container 3 storing the transported object horizontal. As shown in FIG. 6, among the hemispherical capsules 1*a*, 1*b* composing the spherical container 1, inside the capsule 1*b* positioned at the lower part, a balance weight 18 is installed, thus the spherical container 1 is prevented from rotation and during transport, the transported object can be kept horizontal.

Further, instead of the balance weight 18, by use of such a constitution that the lower hemispherical capsule 1*b* is composed of a material heavier than that of the upper hemispherical capsule 1*a*, or in the lower hemispherical capsule 1*b*, iron or a magnet is installed and the installation surface of the spherical container 1 is made of a magnet or iron, thereby is fixed by the magnetic force, or furthermore, on the bottom of the spherical container 1, a flat portion is provided, the similar effect can be obtained.

Figure 4:
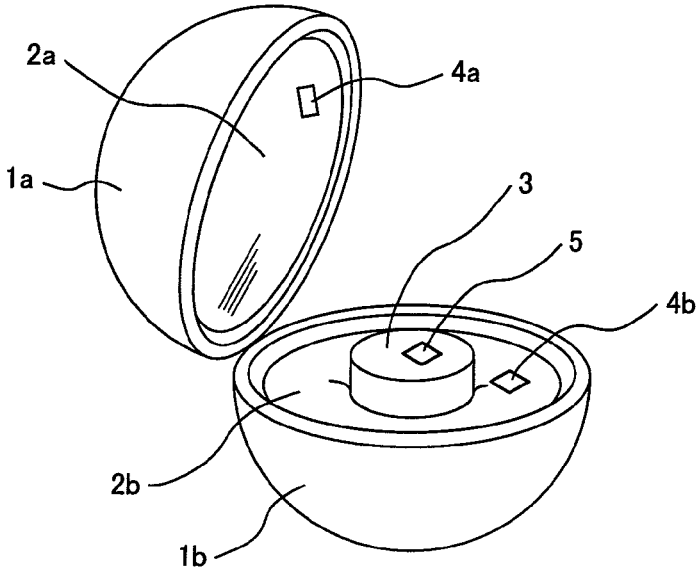
FIG. 4 is a perspective view to show the spherical container of the fourth embodiment in the present invention.
Figure 5:
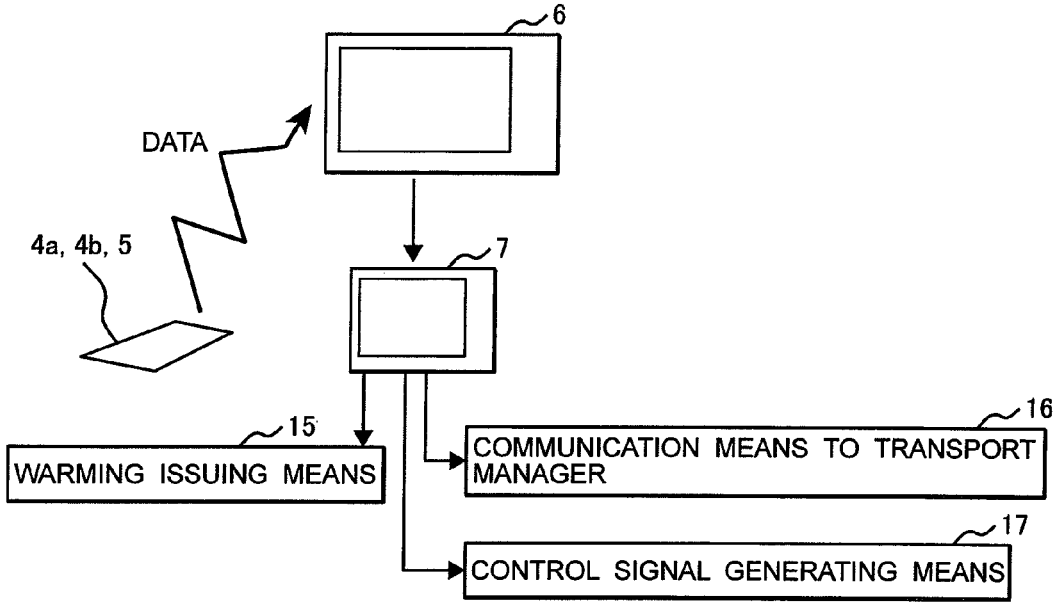
FIG. 5 is a block diagram of data transmission and reception of the fourth embodiment in the present invention.

A further embodiment of the transport container relating to the present invention will be explained by referring to FIGS. 4 and 5. This embodiment adds a data recording and dispatching means 5*a* concerning a transported object and a data recording and dispatching means 4*a*, 4*b* concerning the heat accumulating material 2*a*, 2*b* to the spherical container described in the second embodiment.

Data recorded and dispatched by a data recording and dispatching means 5 concerning a transported object is received by a data reception and display device 6 installed outside the spherical container 1. As data recorded and dispatched, name, date, history, transport destination name, and dispatching source name may be cited. These information is mainly inputted by the dispatching source of the transported object and is protected from rewriting during transport.

Data dispatched by data recording and dispatching means 4*a* and 4*b* concerning the heat accumulating material 2*a*, 2*b* is received by the data reception and display device 6 and then is transferred to a data calculation and output device 7. As data recorded and dispatched, the condition amounts of the heat accumulating material 2*a*, 2*b* such as temperature and distortion (deformation amount) may be cited. From these data, the data calculation and output device 7 calculates the solidification state of the heat accumulating material 2*a*, 2*b* or the like. Further, it has a function for calculating the remaining accumulated heat amount from the calculated solidification state of the heat accumulating material 2*a*, 2*b* and dispatching output of the remaining possible heat insulating time and alarm. As an example, when the estimated possible heat insulating time is shorter than the transport time, a warning is issued by a warning issuing means 15 and it is possible to promote a transport manager to cope with it by a communication means 16 to the transport manager and when the constant temperature transport container body is equipped with a temperature control unit, to transmit a signal instructing heating by a control signal generating means 17.

When a transported object is difficult to directly measure the temperature such as cultured cells used to the regenerating medical treatment, the surface temperature of the container 3 for storing the transported object is measured by the data recording and dispatching means 5 concerning the transported object and it is controlled as a transport control temperature.

According to this embodiment, without opening the spherical container 1, the information of a transported object and transport history such as temperature can be obtained, and the possible heat insulating time is estimated from the condition amount of the heat accumulating material, and the temperature is adjusted, thus the exactitude for the quality guarantee of the transported object can be improved.

Figure 7:
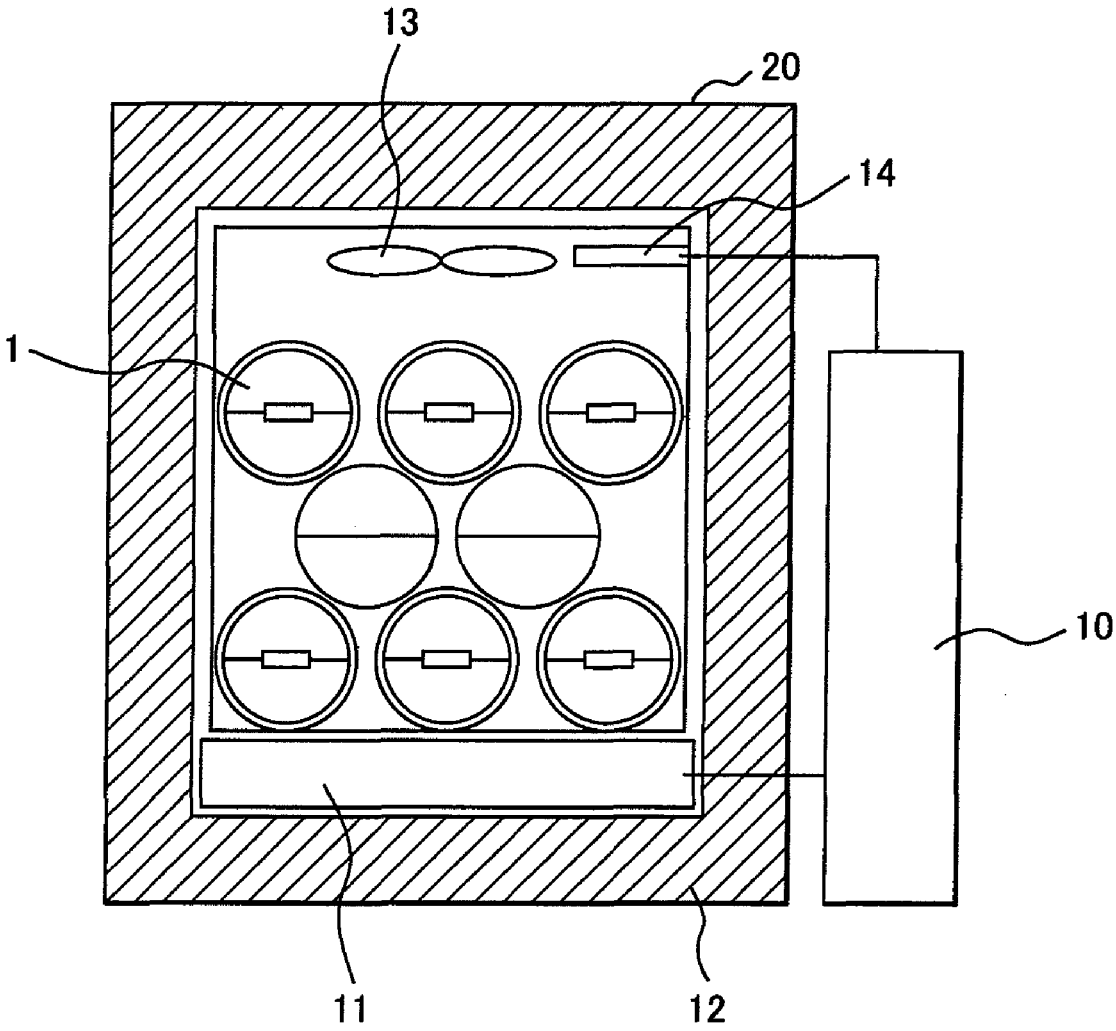
FIG. 7 is a cross sectional view to show the constant temperature transport container and the spherical container of the fifth embodiment in the present invention.

A still further embodiment of the constant temperature transport container relating to the present invention will be explained by referring to FIG. 7. This embodiment relates to the storing method for the spherical container 1 in the constant temperature transport container 20.

In the constant temperature transport container 20, a plurality of spherical containers 1 storing transported objects are installed in the stacked state. The constant temperature transport container 20 includes a temperature control unit 10 such as an electric heater 11 driven by a portable power source, a circulating fan 13 for circulating air in the container 20 to make the temperature uniform, and a temperature measurement sensor 14 for measuring the internal temperature.

The plurality of spherical containers 1 are stacked and installed, thus during transport, the containers 1 are respectively prevented from moving and a space for circulating air between the containers 1 can be obtained. When using square storing containers, a means for preventing movement of the containers and a means for forming a gap for circulating an internal fluid are necessary, though the embodiments of the present invention do not require those means.

Further, the containers 1 are spherical, so that the storing efficiency of the containers in the constant temperature transport container 20 is improved. Furthermore, the contact areas of the spherical containers 1 are small, so that thermal interference due to thermal conduction between the containers can be prevented.

According to the embodiments, an effect can be obtained that without using a particular fixing means, the spherical containers 1 are prevented from moving and even if the internal temperature of the constant temperature transport container 20 becomes non-uniform, the quality deterioration of the transported object can be prevented.

What is claimed is:

1. A transport container, comprising a spherical container having an upper hemispherical capsule and a lower hemispherical capsule for transporting cultured cells as a transported object, a heat accumulating material disposed inside of the spherical container, wherein the heat accumulating material is provided with a space formed at the central part of the inside of the spherical container for holding the transported object therein and is configured to be heated, before cultured cells are transported in the transport container, to a solidification point or higher for accumulating heat, and a device provided inside of the spherical container for recording information and a transport history of the transported object and for dispatching the information and the transport history to outside of the spherical container without opening the spherical container.

2. The transport container according to claim 1, further comprising cultured cells as the transported object provided in the space formed at the central part of the inside of the spherical container.

3. The transport container according to claim 1, wherein the device for recording and dispatching information and a transport history of the transported object, records at least one of name, date, history, transport destination name, and dispatching source name.

4. The transport container according to claim 1, wherein the device for recording and dispatching information and a transport history of the transported object, dispatches at least one of temperature and deformation amount of the heat accumulating material.

5. The transport container according to claim 1, wherein the heat accumulating material has properties of accumulating heat at time of phase change from a solid to a liquid and of emitting latent heat at time of phase change from a liquid to a solid.

6. The transport container according to claim 5, wherein the heat accumulating material is configured in the spherical container such that when at least a portion of the heat accumulating material is in the liquid phase and heat leaks out of the spherical container, an interfacial boundary between the solid phase and the liquid phase of the heat accumulating material moves toward the central part almost concentrically.

* * * * *